US011229252B2

(12) United States Patent
O'Connell

(10) Patent No.: US 11,229,252 B2
(45) Date of Patent: Jan. 25, 2022

(54) HELMET MOUNTED SHROUD

(71) Applicant: Gentex Corporation, Simpson, PA (US)

(72) Inventor: Jason W. O'Connell, Raynham, MA (US)

(73) Assignee: GENTEX CORPORATION, Simpson, PA (US)

( * ) Notice: Subject to any disclaimer, the term of this patent is extended or adjusted under 35 U.S.C. 154(b) by 244 days.

(21) Appl. No.: 16/493,533

(22) PCT Filed: Mar. 13, 2018

(86) PCT No.: PCT/US2018/022222

§ 371 (c)(1),
(2) Date: Sep. 12, 2019

(87) PCT Pub. No.: WO2018/169985

PCT Pub. Date: Sep. 20, 2018

(65) Prior Publication Data

US 2021/0137200 A1 May 13, 2021

Related U.S. Application Data

(60) Provisional application No. 62/470,508, filed on Mar. 13, 2017.

(51) Int. Cl.
*A42B 3/04* (2006.01)

(52) U.S. Cl.
CPC ..... *A42B 3/0406* (2013.01); *A42B 3/04* (2013.01)

(58) Field of Classification Search
CPC ..... A42B 3/0406; A42B 3/04; A42B 3/042; A42B 3/044
USPC ..... 2/422
See application file for complete search history.

(56) References Cited

U.S. PATENT DOCUMENTS 3,130,630 A 4/1964 Dawes
3,507,741 A * 4/1970 Nunes ..... B29C 44/322 428/394
4,670,912 A 6/1987 Hart
4,697,783 A 10/1987 Kastendieck et al.
4,809,942 A 3/1989 Kastendieck et al.
5,367,402 A 11/1994 Holmes et al.
(Continued)

FOREIGN PATENT DOCUMENTS

WO 1999023521 A1 5/1999
WO 2004062400 A2 7/2004
(Continued)

OTHER PUBLICATIONS

International Search Report dated May 31, 2018 for International Application No. PCT/US2018/022222, 2 pages.
(Continued)

*Primary Examiner* — Timothy K Trieu
(74) *Attorney, Agent, or Firm* — Morgan, Lewis & Bockius LLP

(57) ABSTRACT

A retention system comprises a shroud configured to be coupled to a helmet. The shroud includes a front surface and a rear surface and the shroud is configured to be coupled to an accessory device. A flexible element is coupled to the shroud and configured to at least partially secure the accessory device to the shroud. The flexible element extends through the front surface of the shroud.

15 Claims, 12 Drawing Sheets

(56) References Cited

U.S. PATENT DOCUMENTS 5,416,922 A 5/1995 Horvat et al.
5,467,479 A 11/1995 Mattes
5,471,678 A 12/1995 Dor
5,506,730 A 4/1996 Morley et al.
5,542,627 A 8/1996 Crenshaw et al.
5,914,816 A 6/1999 Soto et al.
5,936,538 A * 8/1999 Meschkow ..... A43D 13/00 340/687
6,457,179 B1 10/2002 Prendergast
6,472,776 B1 10/2002 Soto et al.
6,662,370 B1 12/2003 Buchanan, Jr.
6,751,810 B1 6/2004 Prendergast
6,811,348 B1 11/2004 Meyer et al.
6,862,748 B2 3/2005 Prendergast
6,938,276 B1 9/2005 Prendergast
6,957,449 B2 10/2005 Prendergast
6,986,162 B2 1/2006 Soto et al.
7,004,439 B1 2/2006 Taylor et al.
7,219,370 B1 5/2007 Teetzel et al.
7,418,738 B2 9/2008 Prendergast
7,444,683 B2 11/2008 Prendergast et al.
7,504,918 B2 3/2009 Prendergast et al.
7,649,701 B2 1/2010 Prendergast et al.
7,715,125 B2 5/2010 Willey
7,729,063 B2 6/2010 Willey et al.
7,735,159 B2 6/2010 Prendergast
7,805,776 B2 10/2010 Crossman et al.
7,810,168 B2 10/2010 Reed et al.
D635,305 S 3/2011 Lebel et al.
7,996,917 B2 8/2011 Prendergast
8,087,100 B2 1/2012 Aguero et al.
8,120,857 B2 2/2012 Hedges et al.
8,181,269 B2 5/2012 Aguero et al.
8,209,780 B1 7/2012 Lemire
8,238,045 B2 8/2012 Prendergast et al.
8,239,971 B2 8/2012 Prendergast
8,337,036 B2 12/2012 Soto et al.
8,375,473 B2 2/2013 Celona et al.
8,531,592 B2 9/2013 Teetzel et al.
D692,620 S 10/2013 Gendron
8,636,375 B2 1/2014 Soto et al.
8,661,571 B1 * 3/2014 Teetzel ..... F41H 1/04 2/422
8,677,516 B2 3/2014 Prendergast
8,727,556 B2 5/2014 Swan
8,739,313 B2 6/2014 Teetzel et al.
8,826,463 B2 9/2014 Teetzel et al.
8,908,389 B2 12/2014 Teetzel et al.
8,984,665 B2 3/2015 Celona et al.
9,113,129 B2 8/2015 Teetzel et al.
9,116,355 B2 8/2015 Teetzel et al.
9,167,859 B2 10/2015 Bandy et al.
9,243,870 B2 1/2016 Teetzel et al.
D749,794 S 2/2016 Noordzij et al.
D750,847 S 3/2016 Noordzij et al.
9,414,633 B2 8/2016 Bernier et al.
9,433,252 B2 9/2016 Lebel et al.
D774,704 S 12/2016 Hancock et al.
9,565,885 B2 2/2017 Hedges et al.
9,578,916 B2 2/2017 Daniels et al.
9,625,699 B2 4/2017 Teetzel et al.
9,775,395 B2 10/2017 Teetzel et al.
94,778,453 10/2017 Teetzel et al.
2002/0148950 A1 * 10/2002 Wilder ..... A42B 3/042 250/214 VT
2007/0067894 A1 3/2007 Bourree et al.
2007/0114252 A1 5/2007 Gruebel et al.
2008/0263752 A1 10/2008 Solinsky et al.
2009/0038056 A1 2/2009 Bobbin et al.
2009/0059063 A1 3/2009 Gallagher
2009/0135479 A1 5/2009 Soto et al.
2010/0012692 A1 1/2010 Harris et al.
2010/0012693 A1 * 1/2010 Wagemans ..... A42B 1/245 224/181
2010/0083413 A1 4/2010 McGovern
2010/0175172 A1 7/2010 Dempsey et al.
2011/0072562 A1 3/2011 Prendergast
2011/0099695 A1 5/2011 Siviter
2011/0145981 A1 6/2011 Teetzel et al.
2013/0031692 A1 2/2013 Wratten
2013/0291290 A1 11/2013 Bernier et al.
2014/0020159 A1 1/2014 Teetzel et al.
2014/0084120 A1 3/2014 Solinsky et al.
2014/0237708 A1 8/2014 DiCarlo
2014/0245523 A1 9/2014 Teetzel et al.
2014/0327962 A1 11/2014 Teetzel et al.
2014/0373423 A1 12/2014 Teetzel et al.
2015/0002930 A1 1/2015 Teetzel et al.
2015/0089726 A1 4/2015 Long
2015/0264229 A1 9/2015 Teetzel et al.
2015/0282549 A1 10/2015 Lebel et al.
2015/0351482 A1 12/2015 Gendron et al.
2016/0088891 A1 3/2016 Walsh et al.
2017/0027264 A1 2/2017 Bernier et al.
2017/0049176 A1 2/2017 Bernier et al.

FOREIGN PATENT DOCUMENTS

WO 2004090580 A2 10/2004
WO 2005000050 A2 1/2005
WO 2006084223 A2 8/2006
WO 2007002507 A2 1/2007
WO 2007002508 A2 1/2007
WO 2007070449 A2 6/2007
WO 2009045669 A2 4/2009
WO 2010037214 A1 4/2010
WO 2010129397 A1 11/2010
WO 2013192070 A1 12/2013
WO 2016049115 A1 3/2016

OTHER PUBLICATIONS

Written Opinion dated May 31, 2018, for International Application No. PCT/US2018/022222, 4 pages.

Extended European Search Report dated Dec. 14, 2020, for European Patent Application No. 18767889.1, 7 pages.

* cited by examiner

HELMET MOUNTED SHROUD

CROSS REFERENCE TO RELATED APPLICATIONS

This application is a 371 of International Application No. PCT/US2018/022222 filed on Mar. 13, 2018, which claims the benefit of U.S. Provisional Patent Application No. 62/470,508 filed Mar. 13, 2017 entitled "Helmet Mounted Shroud", each of which is incorporated by reference herein in its entirety.

BACKGROUND OF THE INVENTION

The present invention relates to a helmet mounted shroud and, more particularly, to a helmet mounted shroud that includes a retention device.

Helmets may be worn for protection in a variety of settings including recreational use such as rock climbing or used in industry such as by military, firefighter, construction, manufacturing, or police personnel. It is sometimes desirable to have an accessory mounted to the helmet such as a pair of night vision goggles (NVG), camera, face shield, light, battery, or mask. The accessory device may be moveable between a stowed position and a use position. Traditional helmet systems do not offer many options for maintaining the accessory device in either the stowed position or the use position.

An improved shroud for maintaining the position of the accessory device is desired.

BRIEF SUMMARY OF THE INVENTION

In one embodiment, a retention system comprises a shroud configured to be coupled to a helmet. The shroud may include a front surface and a rear surface and the shroud may be configured to be coupled to an accessory device. A flexible element may be coupled to the shroud and configured to at least partially secure the accessory device to the shroud. The flexible element may extend through the front surface of the shroud. The shroud may include a groove and a portion of the flexible element may be within the groove. A first section of the groove may be adjacent the rear surface of the shroud and a second section of the groove may be adjacent the front surface of the shroud. The rear surface of the shroud may be configured to be positioned adjacent to the helmet when the shroud is coupled to the helmet.

In a further embodiment, the retention system includes a helmet and a portion of the flexible element may be positioned between the rear surface of the shroud and the helmet when the flexible element may be within the groove. The shroud may include a crown including a crown groove, a first strut including a first groove, and a second strut including a second groove. The crown groove, the first groove, and the second groove may each be configured to receive a portion of the flexible element. The crown groove may be on the rear surface of the shroud and the first groove may be on the front surface of the shroud. The second groove may be on the front surface of the shroud. The flexible element may include a fastener configured to be detachably coupled to the accessory device.

In a further embodiment, the retention system may include a receiver configured to receive the fastener when the fastener is detached from the accessory device. The receiver may comprise a recess in at least one of a front surface and the rear surface of the shroud. The fastener may comprise at least one of a hook and a carabiner configured to couple to the accessory device. The flexible element may comprise an elastomeric element. A single flexible element may be positioned on more than one side of the shroud. The accessory device may comprise at least one of night vision goggles, a camera, and a light. The flexible element may be configured to laterally stabilize the accessory device. The flexible element may comprise a woven sheath at least partially surrounding a strand of elastomeric material. The woven sheath may comprise nylon. The flexible element may include a fastener on opposing ends of the flexible element.

BRIEF DESCRIPTION OF THE SEVERAL VIEWS OF THE DRAWINGS

The following detailed description of embodiments of the helmet mounted shroud will be better understood when read in conjunction with the appended drawings of an exemplary embodiment. It should be understood, however, that the invention is not limited to the precise arrangements and instrumentalities shown. For example, although not expressly stated herein, features of one or more various disclosed embodiments may be incorporated into other of the disclosed embodiments.

In the drawings.

DETAILED DESCRIPTION OF THE INVENTION

Figure 1:
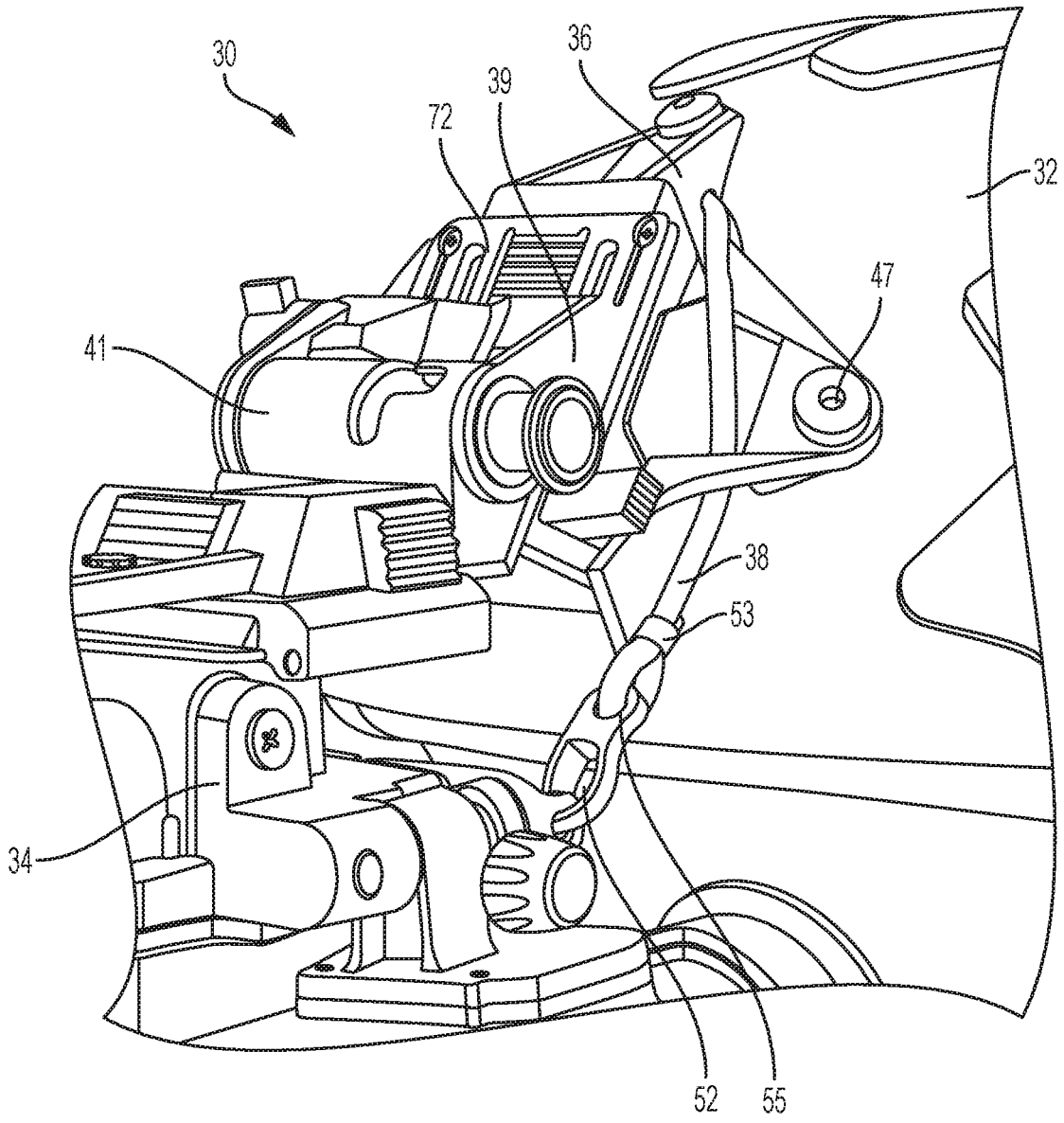
FIG. 1 is a front perspective view of a retention system with an attached accessory device in a use position in accordance with an exemplary embodiment of the present invention.

Referring to the drawings in detail, wherein like reference numerals indicate like elements throughout, there is shown in FIGS. 1-6 a retention system, generally designated 30, in accordance with an exemplary embodiment of the present invention.

Figure 2:
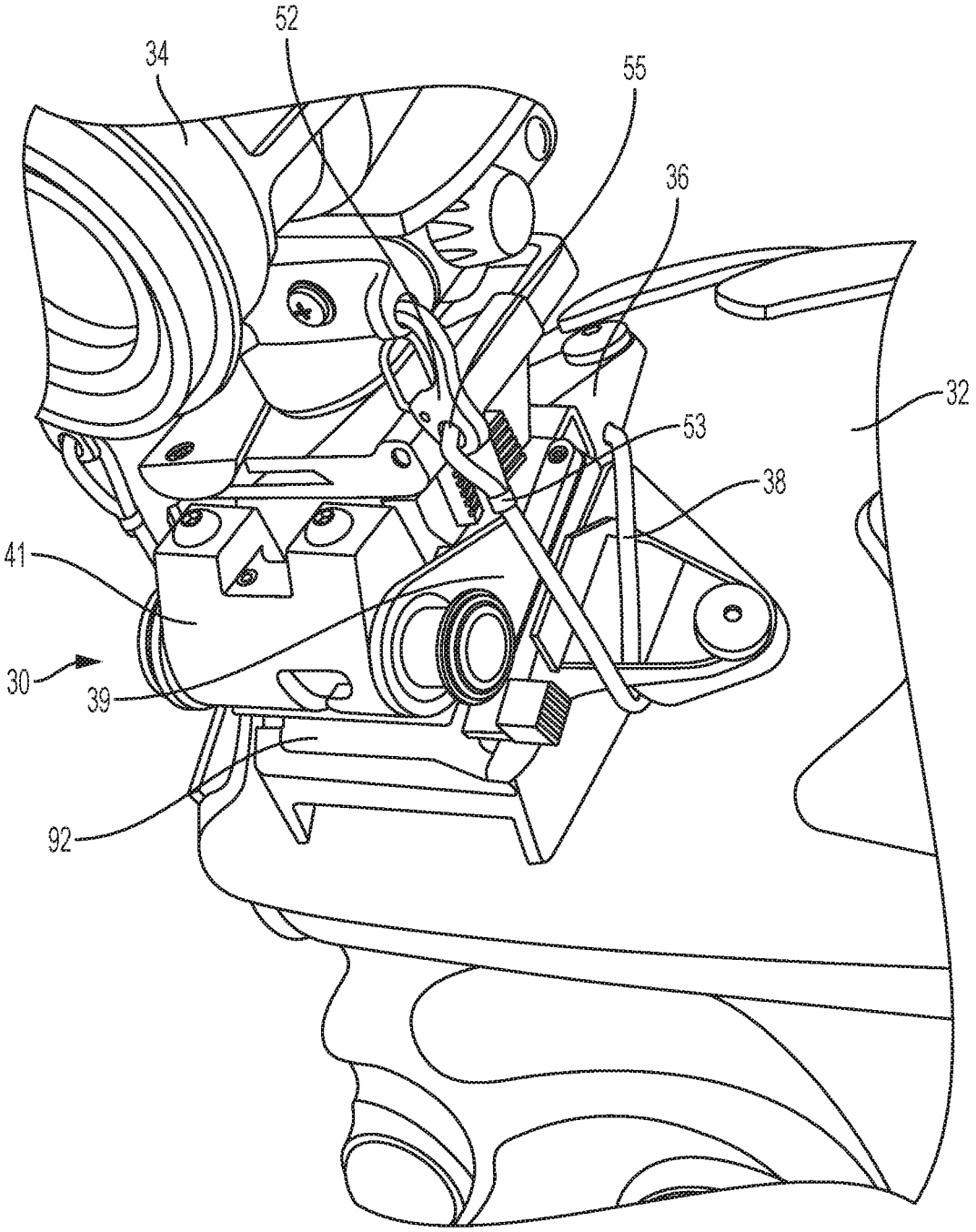
FIG. 2 is a front perspective view of the retention system of FIG. 1 with the attached accessory device in a stowed position.

Referring to FIGS. 1-2, the retention system 30 may be configured to secure an accessory device 34 to a structure such as a helmet 32. The accessory device 34 may be, for example but not limited to, a night vision goggle (NVG), binoculars, a light, a telescope, helmet mounted displays, visors, maxillofacial shields, thermal sight, or a camera. The retention system 30 may include a shroud 36 configured to be attached to the helmet 32. The accessory device 34 may be moveable with respect to the shroud 36 between a stowed position (FIG. 2) and a use position (FIG. 1). The retention system 30 may include a retention element 38 coupled to the shroud 36. The shroud 36 may be configured to be positioned on a front portion of the helmet 32. The accessory device 34 may be positioned in front of a user's face or eyes in the use position.

Referring to FIGS. 1-2, the retention element 38 may be configured to at least partially secure the accessory device 34 to the shroud 36. The retention element 38 may be a flexible element. The retention element 38 may be a flexible element having a fixed length such as a rope, wire, or string. The retention element 38 may be an elastomeric element configured to resiliently expand and contract as the accessory device moves (e.g., between the stowed position and the use position). The retention element 38 may be a cord, bungee, bungie, rope, or string. The retention element 38 may be configured to stretch beyond its original length by about 50% to about 500%, about 100% to about 300%, or up to about 200%. The retention element 38 may stabilize the accessory device 34 (e.g., laterally) by being stretched when the accessory device 34 is in the stowed position or the use position.

The retention element 38 may include a fastener 52 configured to engage the accessory device 34. The fastener 52 may be configured to detachably engage the accessory device 34. The fastener 52 may include a hook, a carabiner, a latch, a hook with spring latch, a spring latch, a magnet, or a cabin hook latch. The fastener 52 may be configured to engage an opening, loop, or receiver on the accessory device 34. The retention element 38 may include a strand or strands of an elastomeric material with a woven sheath over the elastomeric material. The sheath may be manufactured from nylon. The retention element 38 may have a diameter of about 0.125 inches. In other embodiments, the diameter of the retention element 38 may be up to about 0.75 inches.

Figure 10:
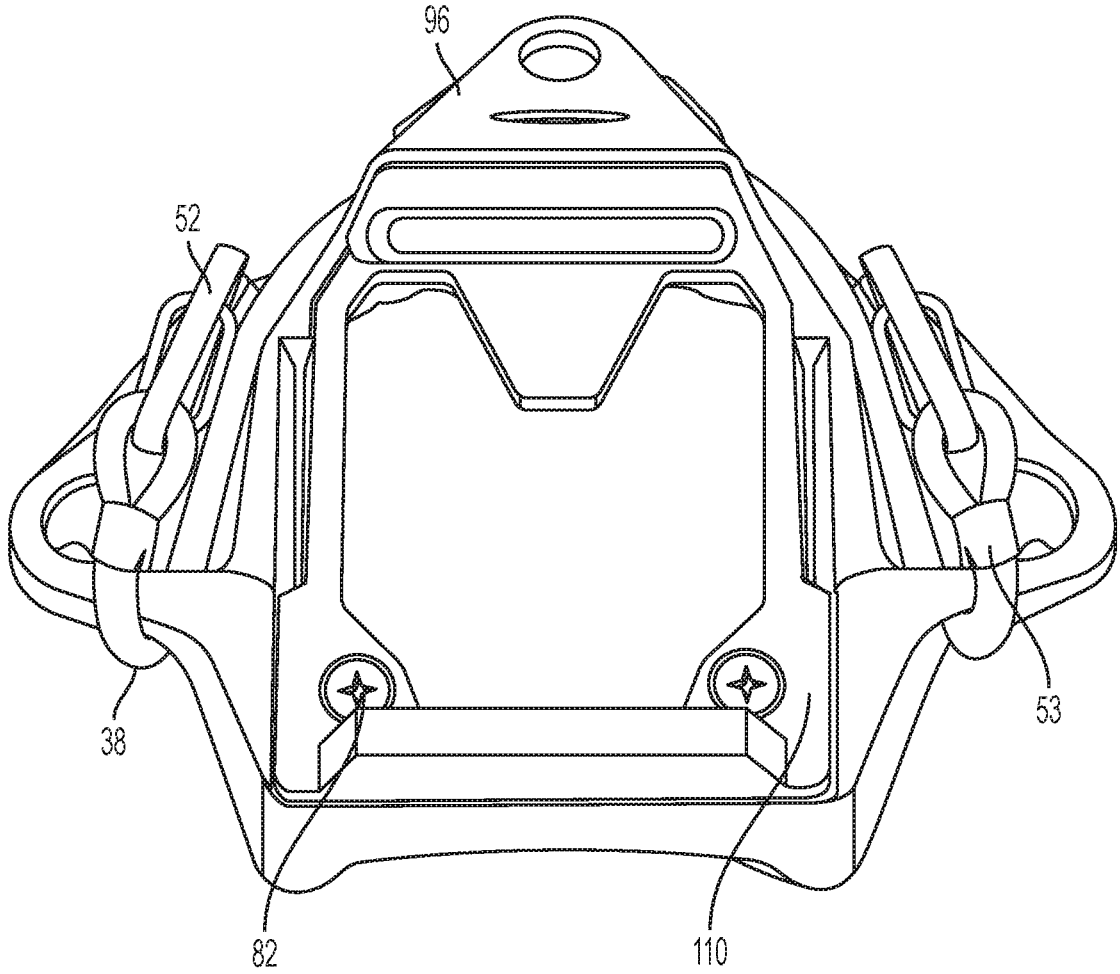
FIG. 10 is a front, bottom perspective view a retention system including the shroud of FIG. 7.

The retention element 38 may include a fastener 52 on opposing ends of the retention element 38. The retention element 38 may include a length between the fasteners 52 of about 3 inches to about 8 inches, about 5 inches to about 6 inches, or about 5.5 inches. The retention element 38 may pass through an aperture 55 in the fastener 52 and the retention element 38 may be attached to itself with a crimped sleeve 53 (FIGS. 1-2 and 10). The fastener 52 may include a channel configured to receive a free end of the retention element 38 and the channel may be crimped to secure the free end within the channel (not shown). The fastener may include a wire hook and the wire may be coiled to form the channel such that the hook and the channel are a unitary construct. The fastener 52 may include adhesive or tape securing the retention element 38 to the fastener or to itself. The retention element 38 may include any number of fasteners 52 along the length of the retention element 38. The retention system 30 may include a plurality of retention elements 38 and each retention element may be configured to at least partially secure the accessory device 34 to the shroud 36. The retention system 30 may include a single retention element 38 adjacent more than one side (e.g., opposing sides) of the shroud 36. The characteristics of the retention element 38 (e.g., length, width, strength) may be selected according to the characteristics (e.g., weight, location of the attachment feature) of the accessory device 34.

In one embodiment, the retention element 38 may be coupled to the shroud 36 by weaving through features of the shroud 36. In other embodiments, the retention element 38 may be fastened to the shroud 36 by a fastener and/or adhesive. A single retention element 38 may be provided with a fastener 52 on each end. In other embodiments, two separate retention elements 38 are provided with one end attached to the shroud and the other free end having a fastener 52.

Figure 3:
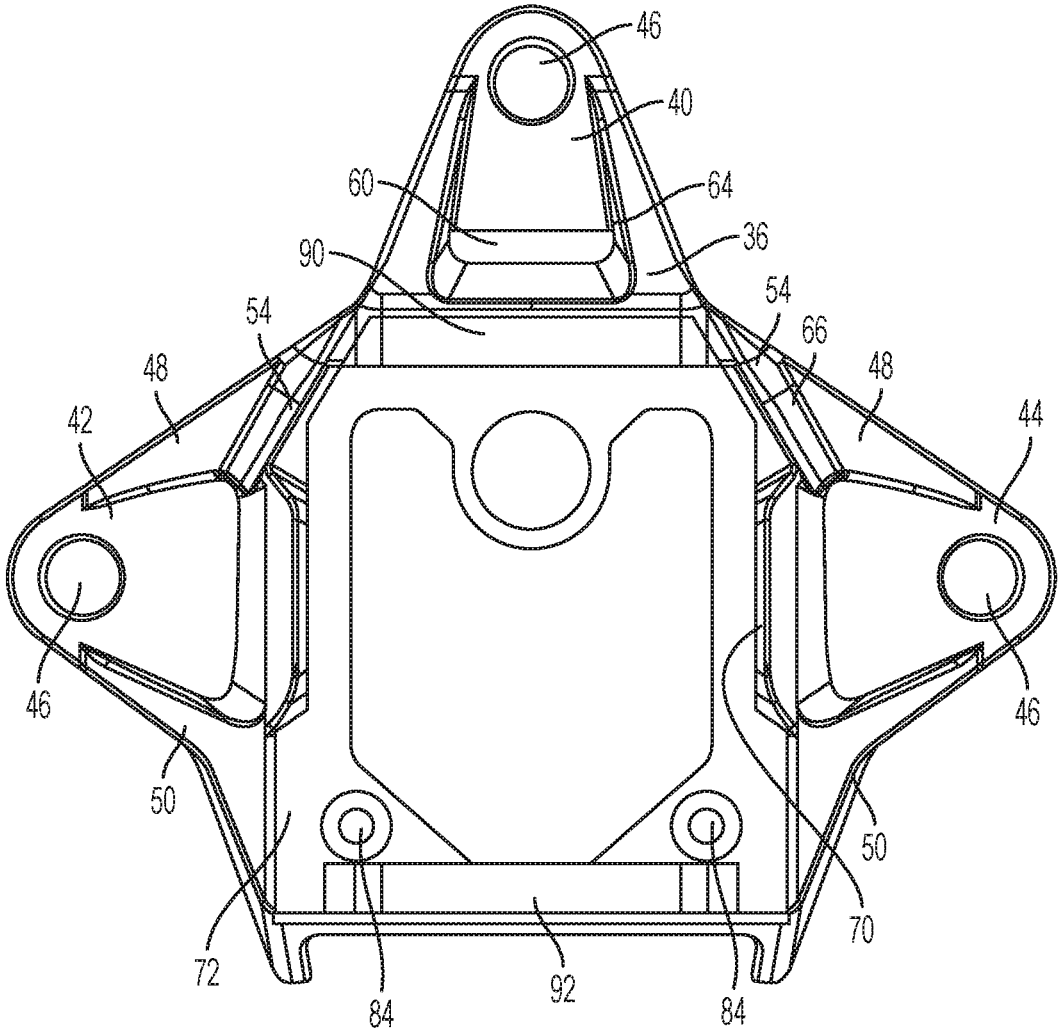
FIG. 3 is a front elevational view of a shroud in accordance with an exemplary embodiment of the present invention.
Figure 4:
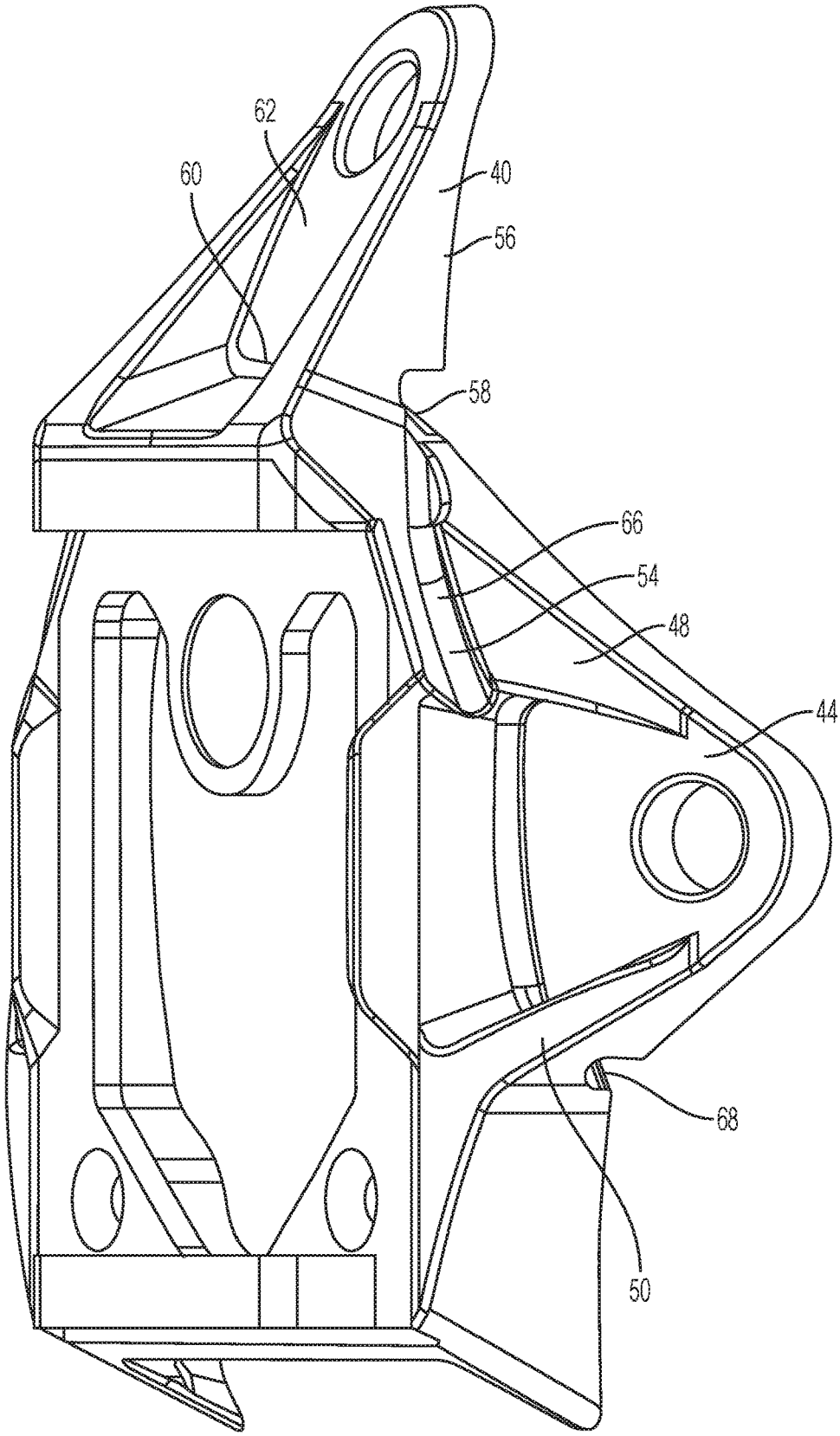
FIG. 4 is a side, perspective view of the shroud of FIG. 3.
Figure 5:
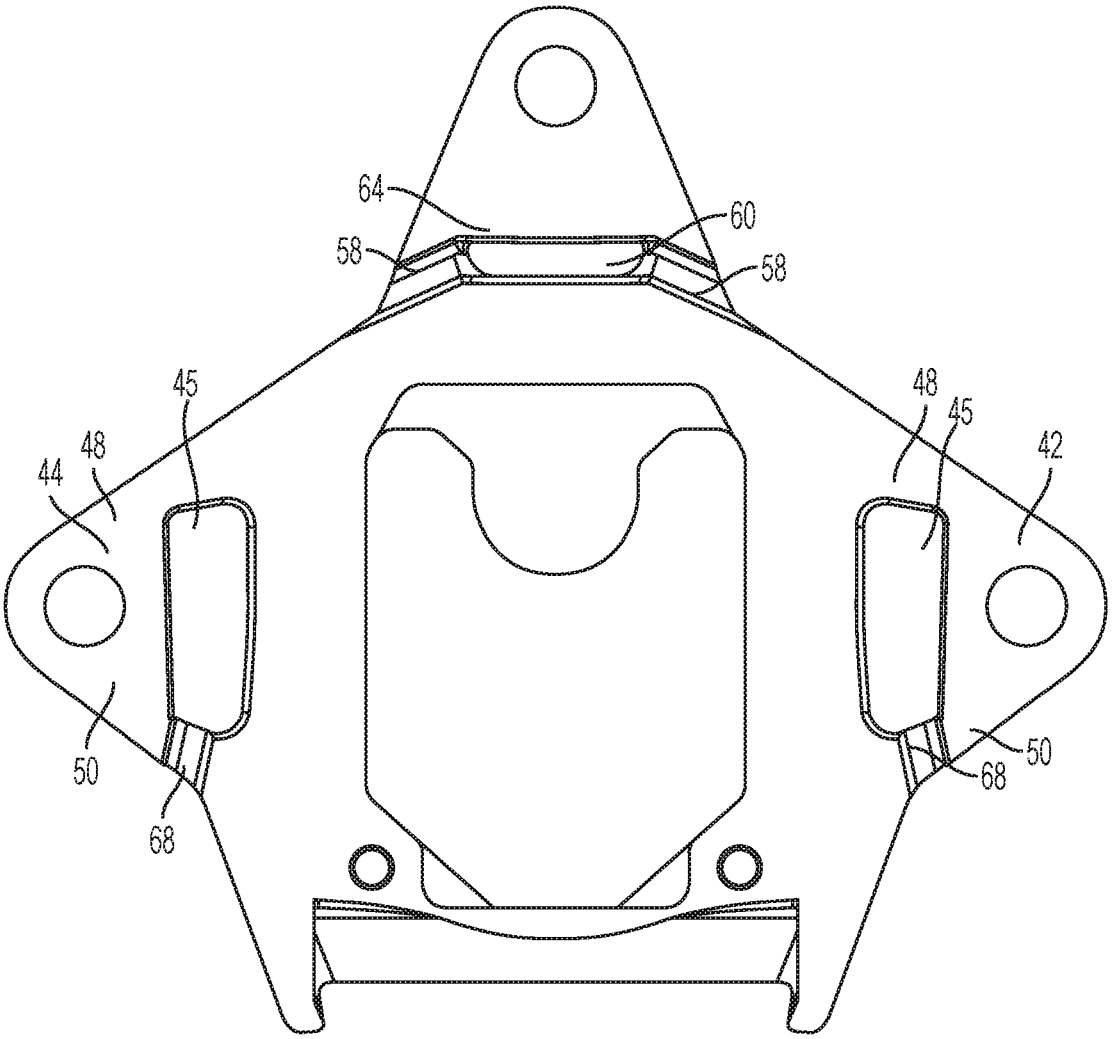
FIG. 5 is a rear, elevational view of the shroud of FIG. 3.
Figure 6:
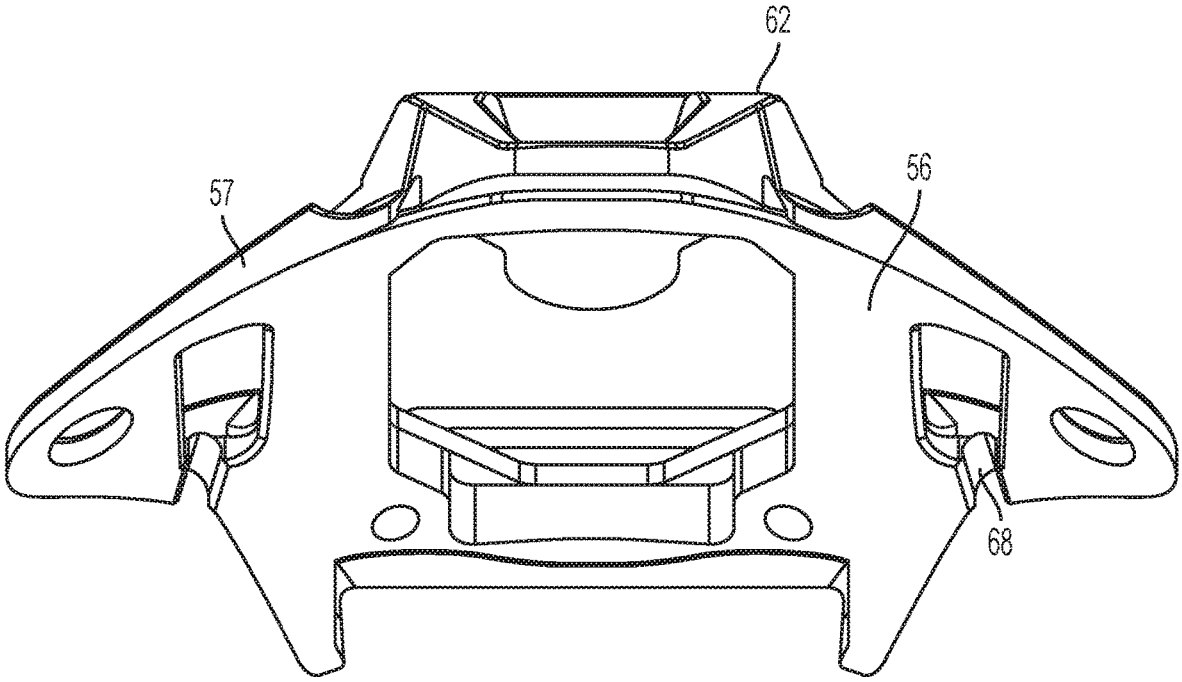
FIG. 6 is a top, rear, perspective view of the shroud of FIG. 3.
Figure 7:
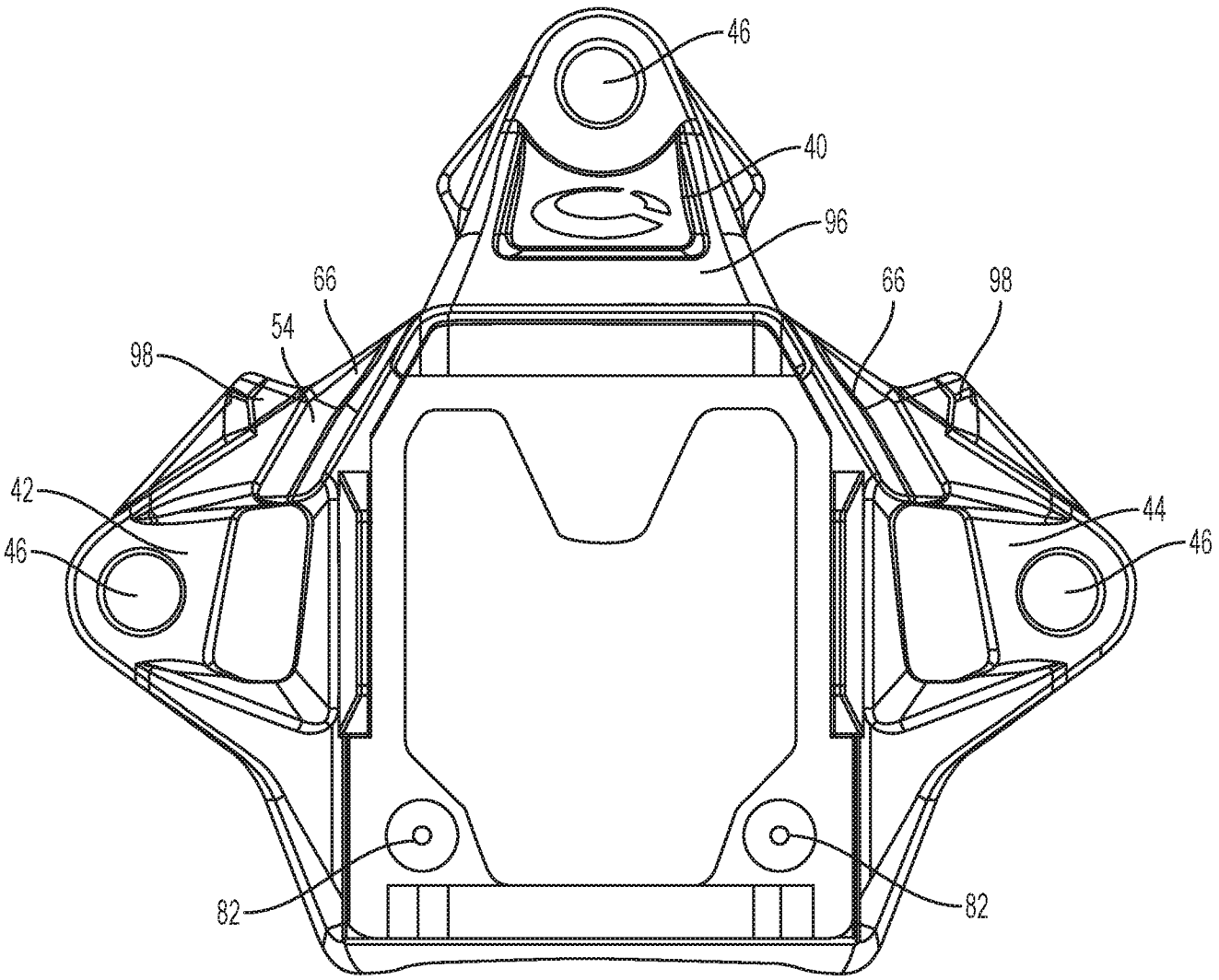
FIG. 7 is a front elevational view of a shroud in accordance with another exemplary embodiment of the present invention.

Turning now to FIGS. 3-5, the shroud 36 may include a groove 54 configured to receive at least a portion of the retention element 38. The groove 54 may include a groove formed in one or more sides of the shroud 36 (e.g., left and right sides, front and back sides or surfaces). The groove 54 may be open to an exterior of the shroud 36. The groove 54 may be enclosed such that the groove includes a tunnel through one or more portions of the shroud 36. The groove 54 may include a combination of grooves and tunnels. The groove 54 may include one or more clips coupled to a surface of the shroud 36. The groove 54 may have a semicircular cross-sectional shape (FIG. 4). The width of the groove 54 may be selected based on the width of the retention element 38. The shroud 36 may have a thickness at the groove 54 of about 2 millimeters to about 4 millimeters. The shroud 36 may have a thickness adjacent the groove 54 of about 2 millimeters to about 6 millimeters. The width of the groove 54 may be selected such that the retention element may be pulled away from the groove 54 without interference from the sidewalls of the groove 54. The width of the groove 54 may be selected such that the retention element 38 and the groove 54 have a snap-fit engagement. The groove 54 may include rounded or chamfered edges to reduce wear on the retention element 38.

The groove 54 may include a first section adjacent a first side 56 of the shroud 36 and a second section adjacent a second side 62 of the shroud 36. The first side 56 and the second side 62 may be opposing sides of the shroud. The first side 56 may be a rear surface of the shroud 36. The second side 62 may be a front surface of the shroud 36. The retention element 38 may extend through the front surface of the shroud 36. An opening 45 may extend from the front surface to the rear surface of the shroud 36. The retention element 38 may extend through the opening 45 when the retention element 38 is within the groove 54. The shroud 36 and the retention element 38 may be provided together. A kit may include a shroud 36 and a plurality of retention elements 38. The kit may include a plurality of retention elements 38 of different size, length, or thickness. In other embodiments, the shroud 36 and retention element 38 may each be provided separately.

The shroud 36 may include a crown 40, a first wing 42, and a second wing 44. The first wing 42 and the second wing 44 may be on opposing sides of the shroud 36. The shroud 36 may be configured to be coupled to the helmet 32. In one embodiment, each of the crown 40, first wing 42, and second wing 44 include a port 46 configured to receive an anchor 47 (anchor shown in FIG. 1). The anchor may be a screw, bolt, rivet, nail, or heat stake. The port 46 may be threaded to receive a threaded anchor. The ports 46 may be arranged to follow a bolt pattern on the helmet 32. The first side 56 of the shroud 36 may be defined by a radius of curvature 57 (best seen in FIG. 6) configured to approximate an outer radius of a helmet 32. The shroud 36 may be flexible such that the shroud 36 can adapt to the exterior surface of a selected helmet or other structure which the shroud 36 is coupled to.

Turning to FIGS. 4-5, the groove 54 may be included in one or more of the crown 40, the first wing 42, and the second wing 44. The crown 40 may include a crown groove 58 open to the first side 56 of the crown 40. The crown 40 may include a crown opening 60 extending from the first side 56 to a second side 62 of the crown 40. The crown groove 58 may be formed on opposing sides of the crown opening 60. The retention element 38 may be visible through the crown opening 60 when the retention element 38 is within the crown groove 58. The crown opening 60 may include a perimeter 64. The retention element 38 may extend across the opening 60 when the retention element 38 is within the crown groove 58.

Still referring to FIGS. 4-5, the first wing 42 and the second wing 44 may each include a first strut 48 and a second strut 50. The groove 54 may include a first section or first groove 66 on the first strut 48. The first groove 66 may be on or adjacent the second side 62 of the first strut 48. The groove 54 may include a second section or second groove 68 on the second strut 50. The second groove 68 may be on or adjacent the first side 56 of the second strut 50. In one embodiment, the first groove 66 and the second groove 68 are on the same side of the first strut 48 and the second strut 50. In another embodiment, the first groove 66 and the second groove 68 are on differing sides of the first strut 48 and the second strut 50. In one embodiment, the first groove 66 and the crown groove 58 are on the same side of the shroud 36. In one embodiment, the second groove 68 and the crown groove 58 are on the same side of the shroud 36. In one embodiment, the first groove 66 and the crown groove 58 are on different sides of the shroud 36. In one embodiment, the second groove 68 and the crown groove 58 are on different sides of the shroud 36. The different sides may be front and back sides. Each of the crown groove 58, the first groove 66, and the second groove 68 may be configured to receive at least a portion of the retention element 38. The retention element 38 may be positioned within the groove 54, including the crown groove 58, the first groove 66, and the second groove 68, and be positioned on different or opposing sides of the shroud 36 when at least one of the crown groove 58, the first groove 66, and the second groove 68 are on a different or opposing side of the shroud 36 than another of the crown groove 58, the first groove 66, and the second groove 68. The retention element 38 may at least partially wrap around one of the first strut 48 and the second strut 50 as the accessory device 34 moves between the stowed position and the use position. A portion of the retention element 38 may be positioned between the helmet 32 and the shroud 36 when the retention element is within the groove 54.

Turning to FIGS. 1-3, the shroud 36 may include a body 70 configured to receive a plate 72. The plate 72 may be configured to engage the accessory device 34. The plate 72 may include an engagement feature (e.g., a rack, a hook, an aperture) to mate with a corresponding feature on the accessory device 34 to secure the accessory device 34 to the shroud 36. The plate 72 may include a first overhang 90 and a second overhang 92. The first overhang 90 and the second overhang 92 may each include a recess configured to receive a portion of a shoe 39. The shoe 39 may include a latch or a retractable engagement feature such that the shoe 39 can be detachably coupled to the first overhang 90 and the second overhang 92 while the plate 72 and shroud 36 are coupled to the helmet 32. The shoe 39 may be configured to be coupled to an accessory device arm 41. The accessory device arm 41 may be configured to be attached to the accessory device 34. The accessory device 34 may be coupled to the helmet 32 such that an order of coupling elements includes the helmet 32, the shroud 36, the plate 72, the shoe 39, the accessory device mounting arm 41 and the accessory device 34.

A coupling element 82 may at least temporarily secure the plate 72 to the shroud 36. The coupling element 82 may include a screw, a bolt, a dowel, or an expandable anchor. The plate 72 may include a plate opening 84 configured to receive the coupling element 82. The body 70 of the shroud 36 may include a body opening 86 configured to receive the coupling element 82. In one embodiment, one or more of the plate opening 84 and the body opening 86 are threaded to mesh with a threaded coupling element 82. The shroud 36 may include a first opening or the port 46 configured to receive the helmet anchor 47 and a second opening or the body opening 86 configured to receive the coupling element 82.

Figure 8:
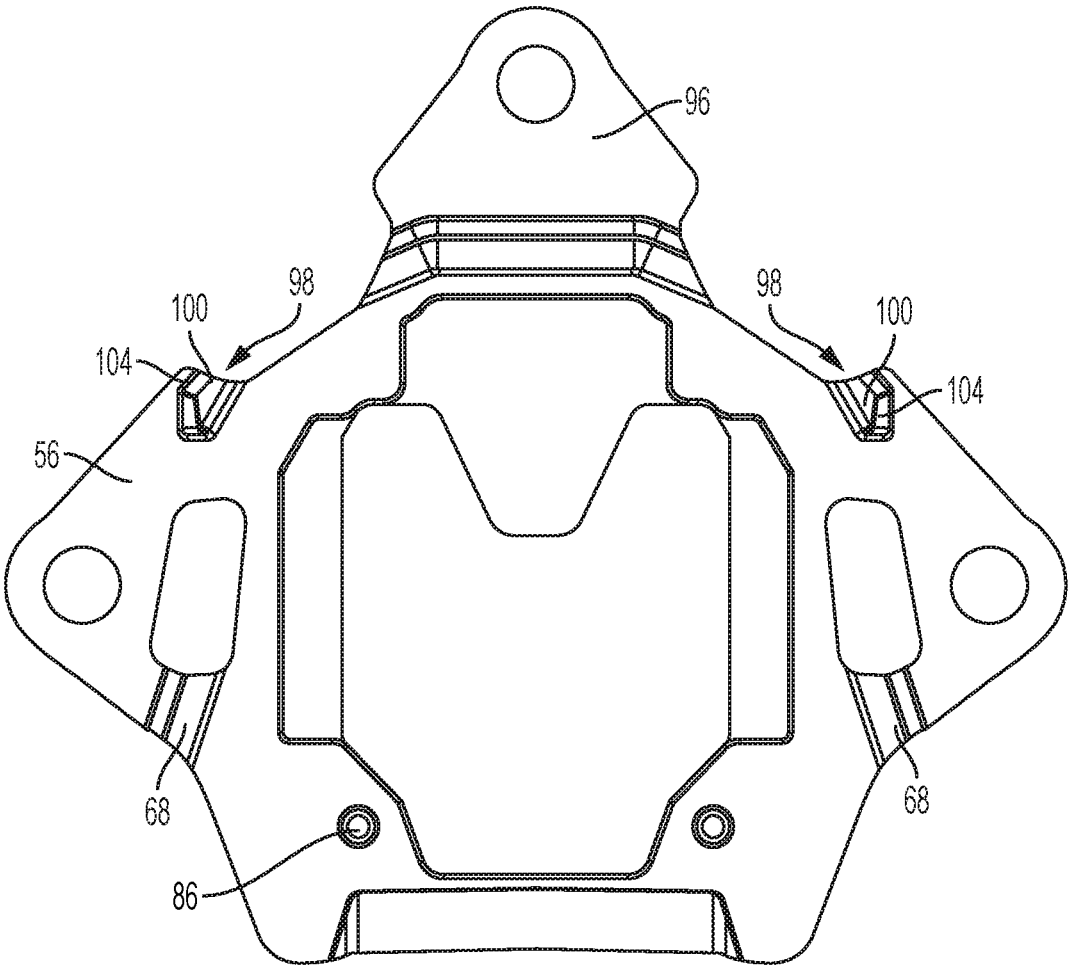
FIG. 8 is a rear elevational view of the shroud of FIG. 7.
Figure 9:
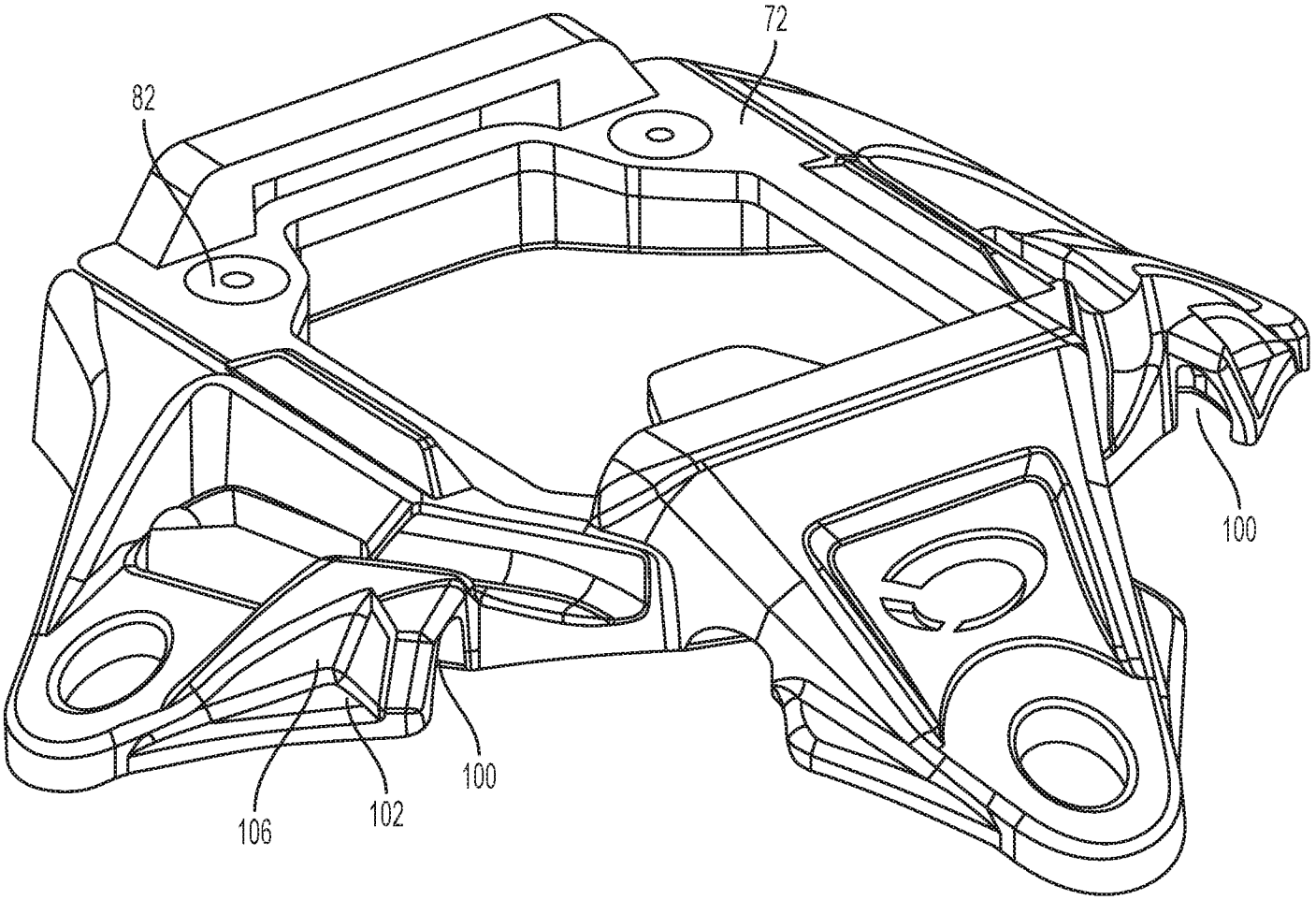
FIG. 9 is a front, side perspective view of the shroud of FIG. 7.
Figure 11:
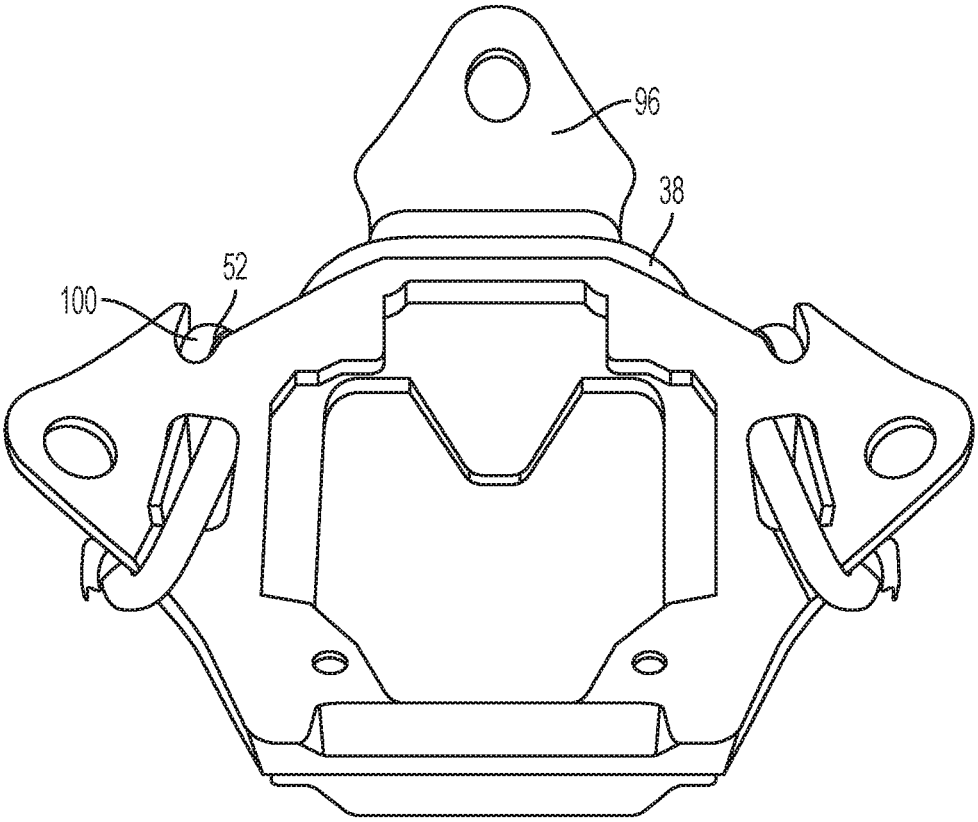
FIG. 11 is a rear, bottom perspective view of the retention system of FIG. 10.
Figure 12:
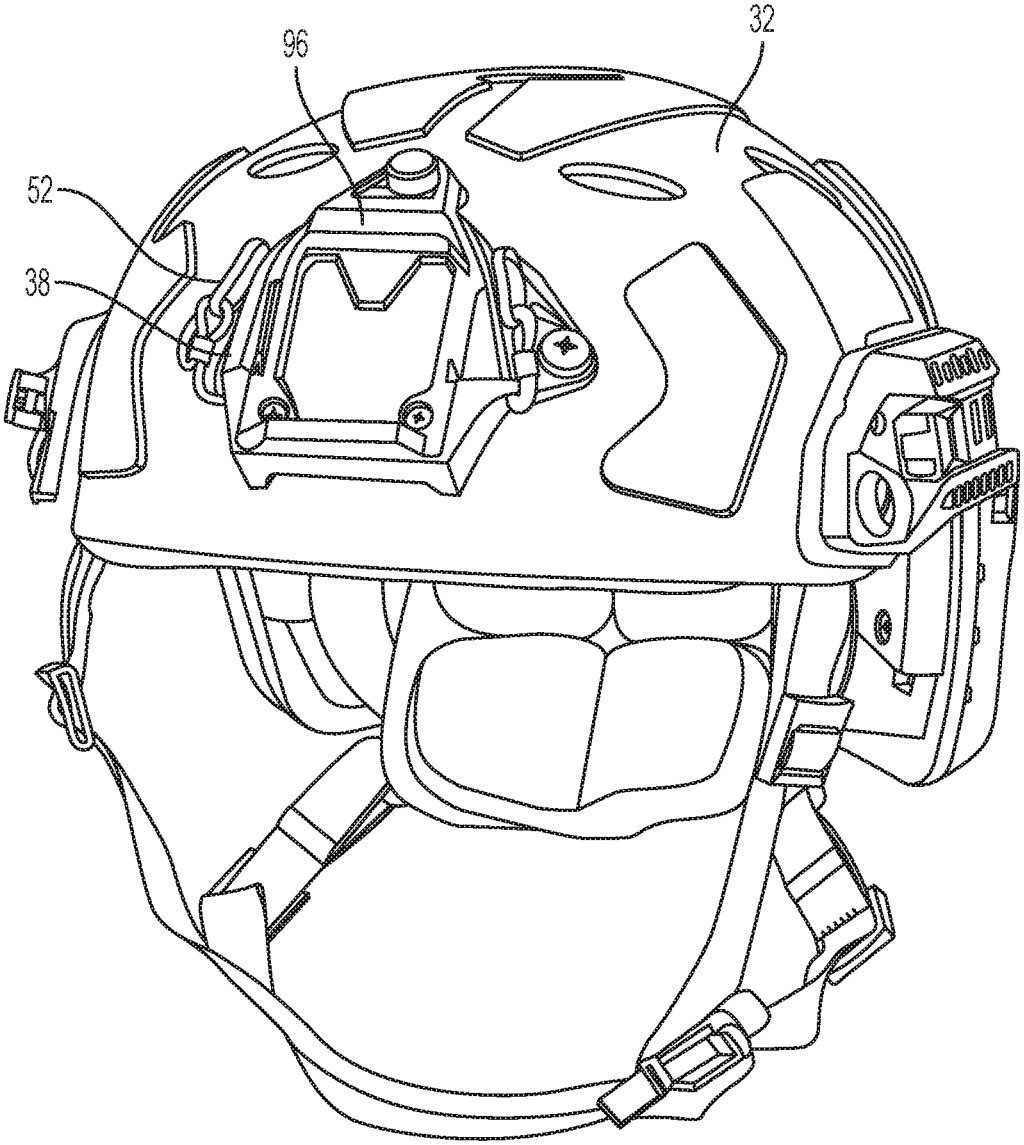
FIG. 12 is a front perspective view of the shroud of FIG. 10 coupled to a helmet.

Referring to FIGS. 7-15, there is shown another embodiment of a shroud 96. The shroud 96 is similar to shroud 36 as both may include a groove 54 configured to receive the retention element 38. The shroud 96 may include a receiver 98 configured to receive the fastener 52 when the fastener 52 is detached from the accessory device 34. The receiver 98 may include a hook, a recess, a loop, or a magnet configured to at least temporarily engage the fastener 52. The structure or design of the receiver 98 may be selected based on the fastener 52. In one embodiment, the receiver 98 includes a first recess 100 on the first side 56 of the shroud 96 (FIG. 8). The first recess 100 may have a perimeter defined by one or more sidewalls 104. In one embodiment, the receiver 98 includes a second recess 102 on the second side 62 of the shroud 96 (FIG. 9). The second recess 102 may have a perimeter defined by one or more sidewalls 106. The first recess 100 and the second recess 102 may each include a groove, a slot, or a portion of the shroud 96 having a reduced thickness compared to an adjacent portion of the shroud. The fastener 52 may engage one or both of the first recess 100 and the second recess 102 when the fastener 52 is engaged with the receiver 98 (FIGS. 10-12). A portion of the fastener 52 may be positioned between the shroud 96 and the helmet 32 when the fastener 52 engages the receiver 98. The retention element 38 may be self-contained by the shroud 96 when the retention element 38 is not connected to the accessory device 34. The retention element 38 may be engaged with only the shroud 96 when the retention element is not connected to the accessory device 34.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. The words "right", "left", "lower" and "upper" designate directions in the drawings to which reference is made. The words "inwardly" and "outwardly" refer to directions toward and away from, respectively, the geometric center of the retention system. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

I claim:

1. A retention system comprising:

a shroud including a front surface, a rear surface, a first side surface, and a second side surface, wherein the rear surface of the shroud is configured to be coupled to a helmet and the front surface of the shroud is configured to be coupled to an accessory device;

a first flexible element coupled to the first side surface of the shroud and configured to at least partially secure the accessory device to the shroud, the first flexible element extending through the front and rear surfaces of the shroud and around the first side surface of the shroud; and a second flexible element coupled to the second side surface of the shroud and configured to at least partially secure the accessory device to the shroud, the second flexible element extending through the front and rear surfaces of the shroud and around the second side surface of the shroud.

2. The retention system of claim 1, wherein the rear surface of the shroud includes a rear groove and a portion of the first flexible element and a portion of the second flexible element are each within the rear groove.

3. The retention system of claim 2, wherein the front surface of the shroud includes a first front groove proximate the first side surface of the shroud and a portion of the first flexible element is within the first front groove, and wherein the front surface of the shroud includes a second front groove proximate the second side surface of the shroud and a portion of the second flexible element is within the second front groove.

4. The retention system of claim 3, wherein the rear surface of the shroud is configured to directly touch the helmet when the shroud is coupled to the helmet.

5. The retention system of claim 2, wherein the first and second flexible elements each have corresponding portions joined to one another such that the first and second flexible elements are integrally formed, and further comprising:

a helmet, wherein a portion of the first flexible element and a portion of the second flexible element where the two portions join is positioned within the groove and between the rear surface of the shroud and the helmet.

6. The retention system of claim 1, wherein an end of the first flexible element includes a first fastener configured to be detachably coupled to the accessory device, and wherein an end of the second flexible element includes a second fastener configured to be detachably coupled to the accessory device.

7. The retention system of claim 6 further comprising:

a first receiver proximate the first side surface of the shroud and configured to receive the first fastener when the first fastener is detached from the accessory device; and a second receiver proximate the second side surface of the shroud and configured to receive the second fastener when the second fastener is detached from the accessory device.

8. The retention system of claim 7, wherein the first receiver and the second receiver each comprises a recess.

9. The retention system of claim 6, wherein the first and second fasteners each comprises at least one of a hook and a carabiner configured to couple to the accessory device.

10. The retention system of claim 1, wherein the first and second flexible elements each comprises an elastomeric element.

11. The retention system of claim 1, wherein the accessory device comprises at least one of night vision goggles, a camera, and a light.

12. The retention system of claim 1, wherein the first and second flexible element are configured to laterally stabilize the accessory device.

13. The retention system of claim 1, wherein the first and second flexible element each comprises a woven sheath at least partially surrounding a strand of elastomeric material.

14. The retention system of claim 13, wherein the woven sheath comprises nylon.

15. A retention system comprising:

a shroud including a front surface, a rear surface, a first side surface, and a second side surface, the shroud have a first lateral wing having a first aperture and a second lateral wing having a second aperture, wherein the rear surface of the shroud is configured to be coupled to a helmet and the front surface of the shroud is configured to be coupled to an accessory device;

a flexible element have a middle portion, a first end portion, and a second end portion, the middle portion of the flexible element being coupled to the shroud, the first end portion of the flexible element extending through the first aperture of the first lateral wing of the shroud from the front surface of the shroud to the rear surface of the shroud and around the first side surface of the shroud, the second end portion of the flexible element extending through the second aperture of the second lateral wing of the shroud from the front surface of the shroud to the rear surface of the shroud and around the second side surface of the shroud;

a first hook fastener coupled to a distal end of the first end portion of the flexible element and configured to selectively couple to either the first side surface of the shroud or the accessory device; and a second hook fastener coupled to a distal end of the second end portion of the flexible element and configured to selectively couple to either the second side surface of the shroud or the accessory device.

* * * * *